US005168734A

United States Patent [19]

Duval et al.

[11] Patent Number: 5,168,734

[45] Date of Patent: Dec. 8, 1992

[54] RE-COMBINATE REMOVABLE PLUG LOCK

[75] Inventors: Robert A. Duval, Fitchburg; Merrill A. Dana, Millbury, both of Mass.

[73] Assignee: RAD Lock, Inc., Worcester, Mass.

[21] Appl. No.: 716,210

[22] Filed: Jun. 17, 1991

[51] Int. Cl.[5] ..... E05B 25/00

[52] U.S. Cl. ..... 70/369; 70/384; 70/358

[58] Field of Search ..... 70/356, 358, 365–369, 70/371, 376, 377, 492, 382–385

[56] References Cited

U.S. PATENT DOCUMENTS

| | | | |
|---|---|---|---|
| 2,142,610 | 1/1939 | Kittler | 70/384 X |
| 2,150,639 | 3/1939 | Simon | 70/368 X |
| 2,390,471 | 12/1945 | Suter | 70/385 |
| 2,603,081 | 7/1952 | Pelle | 70/492 X |
| 3,059,462 | 10/1962 | Check | 70/384 |
| 3,175,379 | 3/1965 | Russell et al. | 70/383 |
| 3,190,093 | 6/1965 | Schlage | 70/383 |
| 3,260,080 | 7/1966 | Wellekens | 70/493 |
| 3,264,852 | 8/1966 | Gysin | 70/376 X |
| 3,290,910 | 12/1966 | Lavinia | 70/383 |
| 3,998,080 | 12/1976 | Fane | 70/338 |
| 4,195,503 | 4/1980 | Roberts | 70/371 X |
| 4,320,640 | 3/1982 | Martikainen | 70/366 |
| 4,531,389 | 7/1985 | Foshee | 70/385 X |
| 4,672,827 | 6/1987 | Craig | 70/367 |
| 4,729,231 | 3/1988 | Wu | 70/384 X |
| 4,836,002 | 6/1989 | Monahan | 70/385 X |
| 4,920,774 | 5/1990 | Martin | 70/367 |
| 4,966,021 | 10/1990 | Boag | 70/383 |
| 5,101,649 | 4/1992 | Duval | 70/369 |

FOREIGN PATENT DOCUMENTS

| | | | |
|---|---|---|---|
| 2646739 | 4/1978 | Fed. Rep. of Germany | 70/384 |
| 709398 | 7/1966 | Italy | 70/383 |
| 766126 | 1/1957 | United Kingdom | 70/384 |

*Primary Examiner*—Richard E. Moore
*Assistant Examiner*—Suzanne L. Dino
*Attorney, Agent, or Firm*—Alex Rhodes

[57] ABSTRACT

A small re-combinate lock for equipment and furniture such as desks and cabinets. The lock is comprised of a generally cylindrical shell and a removable plug rotatably mounted inside of the shell. The plug has a core and a plurality of multi-piece tumblers slideably mounted in the core. Each tumbler is an assembly comprised of a wafer holder and a combining wafer removably mounted at an end portion of the wafer holder. A wafer support ring is mounted on the core adjacent to one side of each tumbler and a rotatable wafer carrier is mounted on the core adjacent to the opposite side of the tumbler. The wafer support ring is keyed to the core and the wafer carrier is rotatable on the core. In each wafer carrier there are a plurality of coded wafers which can be exchanged with the combinating wafer of an adjacent tumbler. To re-combinate the lock, the plug is first removed from the shell with a master key. Thereafter, selected tumblers are re-combinated in accordance with a particular code by exchanging their respective combinating wafers with wafers of the adjacent wafer carriers. The re-combinating of a tumbler in the field requires three rotations of an adjacent wafer carrier, during which its combinating wafer is transferred from a wafer holder onto the adjacent wafer carrier and a substitute wafer is transferred from the carrier onto the tumbler's wafer holder.

17 Claims, 3 Drawing Sheets

RE-COMBINATE REMOVABLE PLUG LOCK

BACKGROUND OF THE INVENTION

This invention relates to re-combinate locks and more particularly to a small key operable re-combinate wafer tumbler lock for furniture and office equipment such as desks and cabinets.

Numerous designs for re-combinate locks exist in the art whose objects are to reduce the cost and time for replacing or re-combinating conventional locks when keys are lost or stolen, or when changes occur in the custodians of equipment. They also reduce the cost and amount of inventory of locks and keys of equipment owners and locksmiths.

One aspect of the prior art is that it is directed to the pin tumbler locks which are used for such purposes as door locks and padlocks, rather than the smaller wafer tumbler locks which are used for desks and cabinets. U.S. Pat. Nos. 3,059,462; 3,175,379, 3,190,093; and 3,998,080 are exemplary of the re-keyable pin tumbler lock prior art. Another aspect of the prior art is that it cannot be applied to the smaller wafer tumbler locks.

Another aspect of the prior art is that non re-combinate wafer tumbler locks are externally marked with codes to identify replacement keys in the event a key is lost. This lessens security because duplicate keys are identified which can be purchased by unauthorized persons.

One desirable feature of a re-combinate wafer tumbler lock is the retention of its outside lock diameter. This is so because equipment manufacturers object to increases in lock diameter. Moreover, maintaining the same diameter allows existing furniture and equipment to be re-fitted with re-combinate locks. Still yet another desirable feature is a simple, easy to use procedure for re-combinating the lock. Still yet another desirable feature is a large number of optional combinations. The small size of current wafer tumbler locks presents a difficult task in providing these desirable features without increasing lock size.

SUMMARY OF THE INVENTION

The present invention satisfies the need for a re-combinate wafer tumbler lock by providing a lock which can be used for original installations or for re-fitting furniture and equipment.

One benefit of the invention is that the outside diameter of a current lock can be maintained.

Another benefit, in addition to the foregoing benefit, is that a re-combination can be performed by an inexperienced, unskilled person.

Another benefit, in addition to the foregoing benefits, is that the cost and amount of inventory of manufacturers, distributors, locksmiths, retailers and equipment owners can be reduced by stocking common lock assemblies.

Another benefit, in addition to the foregoing benefits, is that the increase in the number of different lock components over a non re-combinate wafer tumbler lock is held to a minimum.

Another benefit, in addition to the foregoing benefits, is the elimination of the need to replace locks in the event keys are stolen.

Another benefit, in addition to the foregoing benefits, is improved security, since it is no longer necessary to externally mark the lock with a code to identify a duplicate key.

The invention resides in a number of features which individually and collectively contribute to its ability to re-combinate a wafer tumbler lock. These features relate to 1) a novel multi-piece tumbler comprising a wafer holder and a combinating tumbler removably mounted on an end portion of the wafer holder, 2) a novel wafer carrier adjacent to each tumbler with optional wafers for interchange with the combinating wafer of the tumbler; and 3) a method for interchanging the optional wafers with the combinating wafers to re-combinate the lock.

The lock is comprised of a generally cylindrical shell and a removable plug which is rotatably mounted inside of the shell. The plug has a core, a plurality of spaced apart multi-piece tumblers slideably mounted in the core, an annular support member adjacent to one side of each tumbler for supporting a removable combinating wafer of the multi-piece tumbler, an annular wafer carrier adjacent to the other side of the tumbler for storing optional wafers which can be interchanged with the combinating wafer, and a control tumbler slideably mounted in the core for retaining the removable plug in the shell.

Each of the multi-piece tumblers is comprised of a wafer holder and a combinating wafer removably mounted on an end portion of the wafer holder. In each of the wafer carriers there are receiving pockets for storing optional wafers which can be selectively exchanged with the combination tumblers to re-combinate the lock.

During the re-combinating of the lock the wafer carriers are rotated on the core to position and exchange the combinating wafers with the optional wafers which are removably mounted in the receiving pockets of the wafer carriers.

The foregoing features and benefits, together with additional features and benefits will become more apparent from the ensuing description and drawings which describe the invention in detail. A preferred embodiment and the manner of using the invention are disclosed in the detailed description and the subject matter in which exclusive property rights are claimed is set forth in each of the numbered claims at the conclusion of the detailed description.

DETAILED DESCRIPTION OF THE PREFERRED EMBODIMENT

Figure 1:
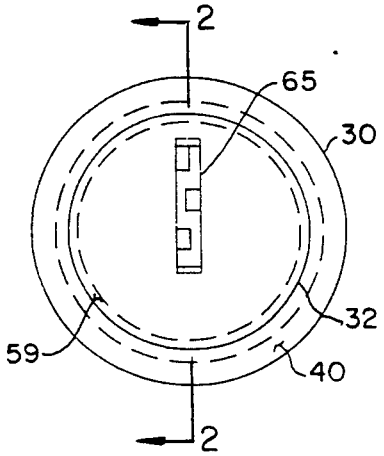
FIG. 1 is a front view of a re-combinating removable plug wafer tumbler lock which embodies the present invention.

Referring now to the drawings wherein like numerals designate like and corresponding parts throughout the several views, a re-combinate wafer tumbler lock, generally designated by the numeral 30, is shown for illustrative purposes which embodies the present invention. The lock 30 has a generally cylindrical shell 31, a removable plug 32 rotatably mounted in the shell 31, and a coupling 33 having a square socket 34 for engaging a square drive 35 at the end of the plug 32. The coupling 33 is retained in the shell 31 when the plug 32 is removed from the shell 31. A cylindrical rear end portion 36 of the coupling 33 extends through an aperture 50 of the rear wall 37 of the shell 31 and attaches with a conventional fastener 39 to a cam 38, or some other member for locking a drawer or door (not shown). The shell 31 is conventional and has an enlarged head portion 40, a threaded outer portion 41 and a pair of flats 42 for mounting the lock 30 in the drawer or door.

Figure 2:
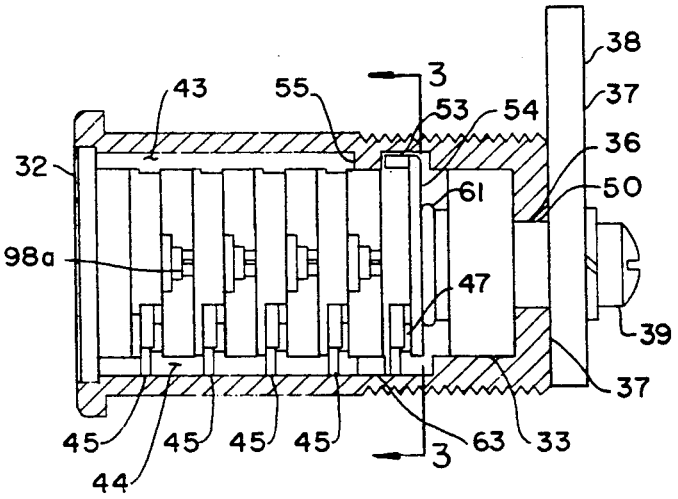
FIG. 2 is a view taken on the line 2—2 of FIG. 1, showing the outer shell of the lock in cross-section and a removable plug in full view rotatably mounted in the shell.
Figure 15:
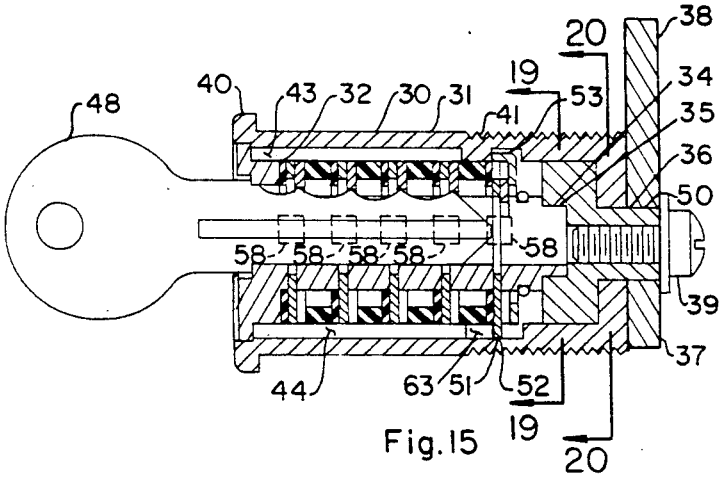
FIG. 15 is a longitudinal cross-sectional view taken on the line 2—2 of FIG. 1 showing the lock with a standard key in the plug of the lock.

Extending longitudinally through the shell 31 are an upper spline 43 and a diametrically opposed lower spline 44. In a locked condition, such as depicted in FIG. 2, the lower spline 44 engages the end portions 45 of a plurality of combinating tumblers 46 to prevent a rotation of the plug 32 in the shell 31. In the locked condition, the combinating tumblers 46 are biased downwardly into the lower spline 44 by leaf springs 47 which will be later described. The multi-piece tumblers 46 perform in the same manner as conventional unitary tumblers, i.e., when a proper key 48, as shown in FIG. 15, is inserted into the plug 32, the tumblers are urged by the key 48 upwardly to disengage the tumblers' lower end portions 45 with the lower spline 44 and allow the plug 30 to rotate in the shell 31 to an unlocked condition. If an improper key is inserted into the plug 32, either some of the tumblers 46 will engage the lower spline 44 or the tumblers 46 will engage the upper spline 43 (depending on the cut of the key) to prevent a rotation of the plug 32 in the shell 31.

Figure 5:
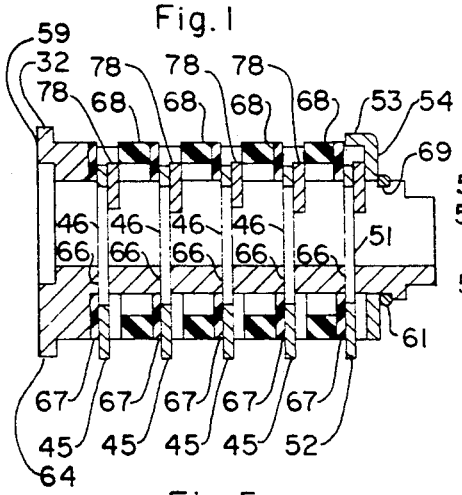
FIG. 5 is a cross-sectional view taken on the line 5—5 of FIG. 4.
Figure 4:
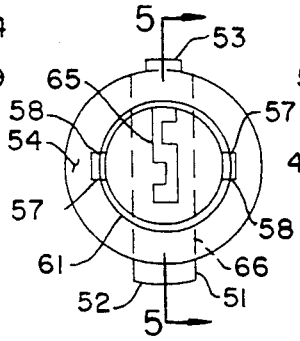
FIG. 4 is a rear end view of the removable plug.
Figure 3:
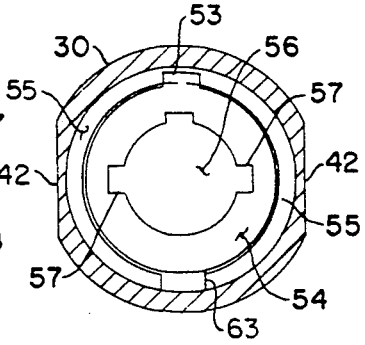
FIG. 3 is a cross-sectional view taken on the line 3—3 of FIG. 2.

The removable plug 32 may be retained in the shell 31 by any of the various means known in the art, it being our intention to not limit our invention to a particular retaining means. The retaining means, shown in the illustrated embodiment, is fully disclosed in the copending application of Robert Duval, Ser. No. 07/431,034, U.S. Pat. No. 5,101,649, which is incorporated herein by reference. At the tail end of the plug 32 there is a master control tumbler 51 which will be later more fully described. In FIGS. 2 and 15 and, the lower end portion 52 of the master control tumbler 51 and a tab 53 on a blocker ring 54 overlap an annular wall 55 in the interior of the shell 31 to prevent the withdrawal of the plug 32 from the shell 31. With reference to FIGS. 3 through 5, the blocker ring 54 is a thin annular member having an aperture 56, a pair of keyways 57 which engage corresponding keys 58 of a core 59 and the forward extending peripheral tab 53.

Figure 16:
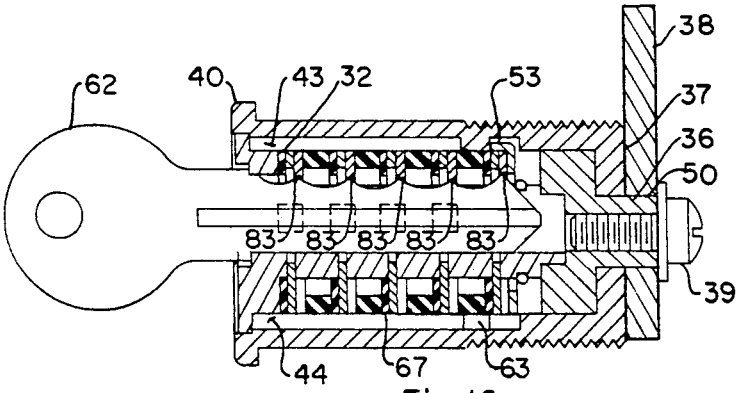
FIG. 16 is a longitudinal cross-sectional view taken on the line 2—2 of FIG. 1 showing the lock with a master key inserted into the plug of the lock.
Figure 17:
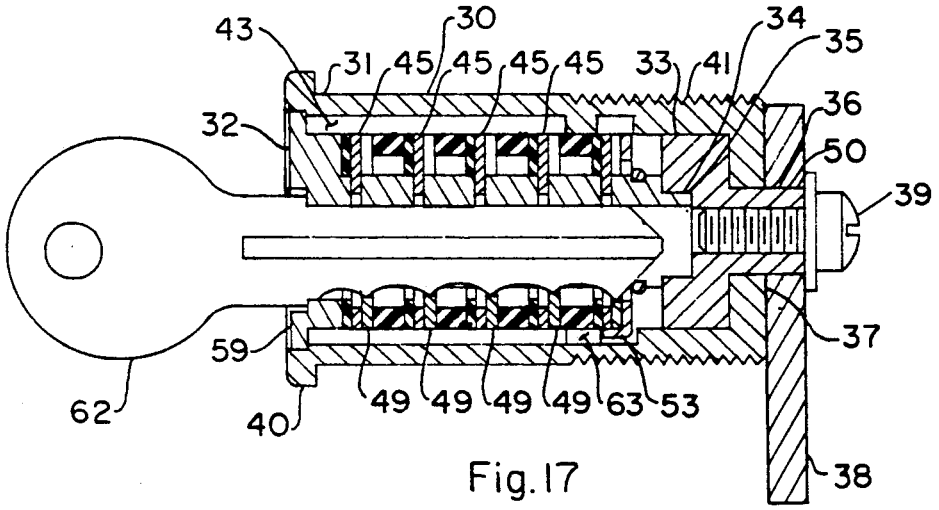
FIG. 17 is a longitudinal cross-sectional view taken on the line 2—2 of FIG. 1 showing the lock with a master key in the plug and the plug rotated to an unlocked condition to allow removal of the plug from the shell.

When a longer master key 62, as depicted in FIG. 16, is inserted into the plug 32, the bited portions 83 of the master key 62 elevate the combinating tumblers 46 and the control tumbler 51 to disengage the combinating tumblers 46 from the lower spline 44 and the control tumbler 51 from the annular wall 55. A rotation of the plug 32, as shown in FIG. 17, to an unlocked condition aligns the tab 53 of the blocker ring 54 wit a slot 63 in the annular wall 55 to allow the withdrawal of the plug 32 from the shell 31.

The construction of the plug 32 is best understood by reference to FIGS. 3 through 14, inclusive. The core 59, at the center of the plug 32, is a generally cylindrical member which extends longitudinally through the plug 32. The core 59 has an enlarged head portion 64, a longitudinal keyhole 65, and a plurality of transverse apertures 66 for slideably mounting the combinating tumblers 46 and the control tumbler 51 in the core 59. Adjacent to forward side of each of the combinating tumblers 46 is a wafer support ring 67 which is fixed against rotation on the core 59 by the engagement of the pair of keyways 57 with the keys 58 of the core 59.

Adjacent to the rear side of each of the tumblers 46 there is a wafer carrier 68 which is rotatably mounted on the core 59. The wafer carriers 68, wafer support rings 67 and blocker ring 54 are axially retained on the core by a split circular ring 61 which engages an annular groove 69 at the rear of the core 59.

Figure 12:
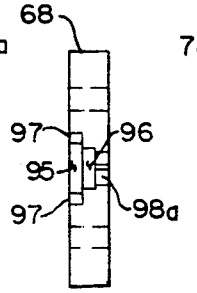
FIG. 12 is a left side view of the wafer carrier without the wafers of FIG. 11.
Figure 10:
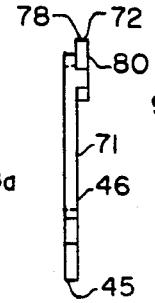
FIG. 10 is a left side view of the tumbler shown in FIG. 9.
Figure 9:
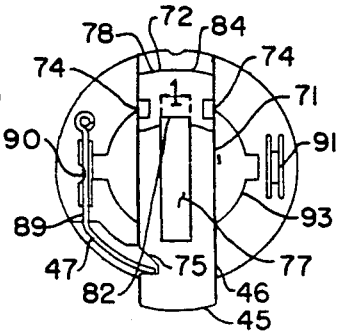
FIG. 9 is a rear view of a wafer support assembly shown in FIG. 6 and a tumbler.

The construction of the multi-piece tumblers 46 is illustrated in FIGS. 9 and 12. The tumblers 46 are assemblies which are comprised of identical wafer holders 71 and detachable coded wafers. In the illustrated embodiment, for each tumbler there is a set of four wafers 72, 72*a*, 72*b* and 72*c*, one of said set being mounted on an end portion of a wafer holder 71 and three being mounted in three receiving pockets 92 of a wafer carrier 68. In the initial assembly of the core 59, later described, all of the wafers 72, 72*a*, 72*b* and 72*c* are mounted in the pockets 92 of the wafer carriers 68.

The wafer holder 71 is a thin generally rectangular stamped member having an arcuate end portion which forms the lower end portion 45 of a tumbler 46 and an upper end portion with a pair of small tabs 74 for retaining the wafer to the end of the wafer holder 71. In a lower side portion of the wafer holder 71 there is a notch 75 for engaging the end portion 76 of the spring 47 which biases the tumbler 46 downwardly into the lower spline 44 of the shell 31 when the key 48 is withdrawn from the plug 32. In the center of the wafer holder 71 there is a rectangular clearance aperture 77 for the key 48.

Figure 21:
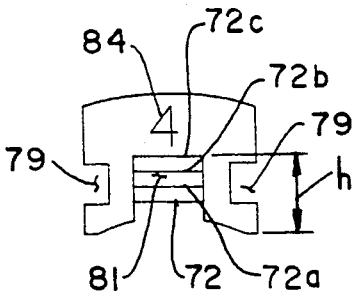
FIG. 21 is an enlarged view of a set of four wafers superimposed upon each other.
Figure 19:
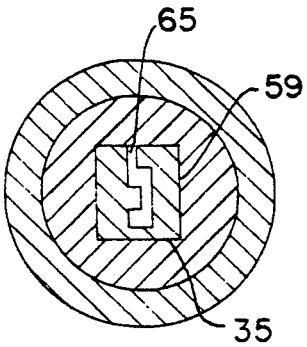
FIG. 19 is a cross-sectional view taken on the line 19—19 of FIG. 15.
Figure 20:
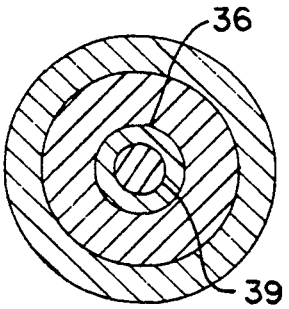
FIG. 20 is a cross-sectional view taken on the line 20—20 of FIG. 15.

The wafers 72, 72*a*, 72*b* and 72*c* are thin stamped members having arcuate upper end portions 78 which form the upper end portions of the tumblers 46 and pairs of notches 79 in sides 80 which engage the tabs 74 of the wafer holders 71. The lower portions of the wafers 72, 72*a*, 72*b* and 72*c* have notches 81 with upper edges 82 that are acted upon by bited portions 83 of the key 48 to elevate the tumblers 46 and retract the tumblers' lower end portions 45 from the lower spline 44. As depicted in FIG. 21, showing the four wafers 72, 72*a*, 72*b*, 72*c* superimposed on each other, the wafers 72, 72*a*, 72*b*, 72*c* are identical except for heights "h" of the notches 81 and code numerals 84 stamped in the sides of the wafers which identify the wafers 72, 72*a*, 72*b*, 72*c*.

The wafers 72 are supported on the core 59 by identical support rings 67 which are adjacent to the forward sides of the tumblers 46. The construction of the support rings 67 is illustrated in FIGS. 6 through 9, inclusive.

The support rings 67 are annular disc shaped members and are preferably molded from a plastic material. In the rearward side of each support ring 67 there is a recess 85 for receiving the wafer holder 71 and wafer mounted on the upper end of the wafer holder 71 as depicted in FIG. 9. In the center of the support ring 67 there is an aperture 86 with a pair of diametrically opposed keyways 87 for engaging the keys 58 which are integral with the core 59 (to prevent rotation of the support ring on the core). When the support ring 67 is installed on the core 59, the recesses 85 are aligned with the transverse apertures 66 of the core 59 to form channels for slideably mounting and supporting the tumblers 46 on the core 59. The keys 58 which engage the keyways 87 do not extend beyond the sides of the support rings 67 to enable the wafer carriers 68 to be rotatable on the core 59.

Figure 6:
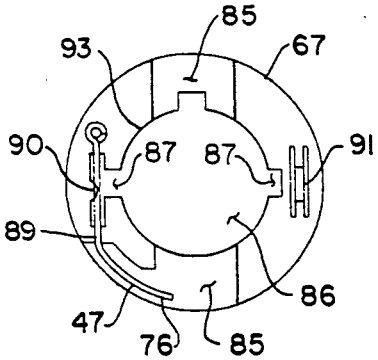
FIG. 6 is a rear view drawn to an enlarged scale from FIG. 1 of a wafer support assembly of the rotatable plug.
Figure 8:
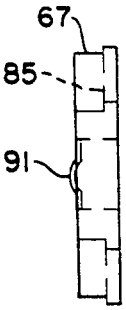
FIG. 8 is a right side view of the wafer support assembly shown in FIG. 6.

With reference to FIG. 6, in one side of the support ring 67 there is a groove 89 which receives a portion of the leaf spring 47 that biases the tumbler 46 downwardly. The leaf spring 47 is retained in the support ring 67 by the groove 89 and an arcuate tab 90 which is integral with the ring 67. In the side portion of the ring 67, opposite the leaf spring 47 there is an integral detent 91 to remove end play between the support ring 67 and an adjacent wafer carrier 68 and to radially position the wafer carrier 68 on the core 59.

Figure 11:
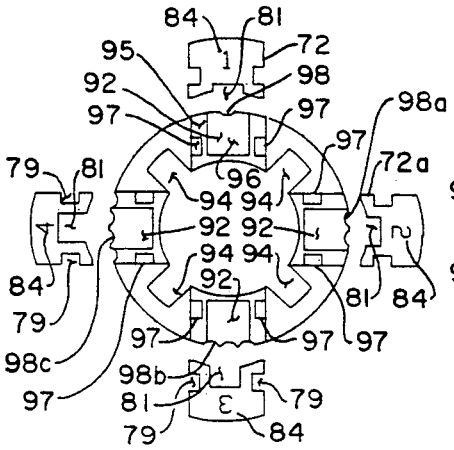
FIG. 11 is a front view of a wafer carrier of the rotatable plug and four optional wafers shown displaced from their normal mounting positions on the carrier for illustrative purposes.

The construction of the wafer carriers 68 is illustrated in FIGS. 11 through 14, inclusive. Each of the wafer carriers 68 is an identical annular disc shaped member, preferably molded from a plastic material. With reference to FIG. 11, in the forward side of each wafer carrier 68 there are four pockets 92 for receiving the set of four wafers 72, 72*a*, 72*b*, 72*c* and at the center of the wafer carrier 68 there is an aperture 93 with four notches 94. In the orientation of FIG. 11, the pockets 92 are positioned at 0, 90, 180 and 270 degrees and the notches are positioned at 45, 135, 225 and 315 degrees.

With reference to FIGS. 11 and 12, the pockets 92 of the wafer carrier 68 are comprised of two levels. One level 95 is shallow and is adapted to closely fit the wafers 72, 72*a*, 72*b*, 72*c* whereas the other level 96 is deeper to provide a recess for a blunt tool (not shown) which is used for removing the wafers 72, 72*a*, 72*b*, 72*c* to re-combinate the lock 30. Extending inwardly from the sides of the shallower recess 95 are a pair of small rectangular bosses 97 which receive the notches 79 of the wafers 72, 72*a*, 72*b*, 72*c*. In the outer edge of the wafer carrier 68, opposite each of the pockets 92, there are notches 98, 98*a*, 98*b*, 98*c* for identifying the tumblers 72, 72*a*, 72*b*, 72*c* when the wafer carriers 68 are mounted on the core 59 and the code numerals 84 are obscured.

In the embodiment which is illustrated herein, one of the multi-piece tumblers 46 is used for the control tumbler 51 to retain the plug 32 in the shell 31. It should be noted that a unique single piece control tumbler can be used in lieu of the multi-piece control tumbler 51.

The assembly of the lock 30 is best understood by reference to FIGS. 3 through 5 and 15 in conjunction with the ensuing description.

Assembly of the Lock

A. Assembly of the Plug

Figure 13:
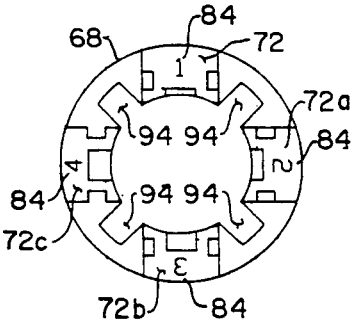
FIG. 13 is a front view of the wafer carrier of FIG. 11 as oriented in its re-combinating position.

After the wafers 72, 72*a*, 72*b*, 72*c* are stamped, they are preferably loaded into tubes or other holders (not shown) to align them for automated assembly onto the wafer carriers 68. The wafer carriers 68 may also be loaded into holders (not shown) to align them for the automated assembly. Prior to the assembly of the wafer carriers 68 onto a core 59, the tubes are loaded into an assembly machine (not shown) which installs the wafers 72, 72*a*, 72*b*, 72*c* in its proper pocket 92 of the wafer carrier 68. Each of the wafer carriers is assembled with four coded wafers 72, 72*a*, 72*b*, 72*c* snapped into their corresponding recesses 92 of the wafer carrier 68 as shown in FIG. 13.

Figure 7:
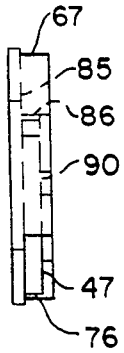
FIG. 7 is a left side view of the wafer support assembly shown in FIG. 6.

The leaf springs 47 are assembled onto the wafer support rings 67 as shown in FIGS. 6 and 7. During their assembly onto the support rings 67, the center portions of the leaf springs 47 are deflected inwardly to clear the small arcuate tabs 90 of the support rings 67. After the wafer carriers 68 and support rings 67 have been assembled, the carriers 68 and rings 67 are assembled onto a core 59 in the following manner.

An assembled support ring 67 is oriented as shown in FIG. 6 with the tumbler recesses 85 facing rearwardly away from the head 64 of the core 59 and slid onto the core 59.

Figure 14:
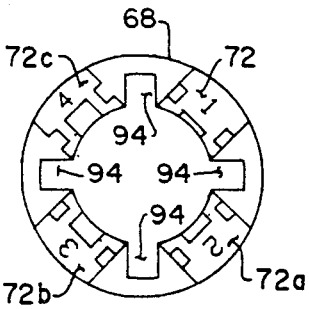
FIG. 14 is a front view of the wafer carrier of FIG. 13 as oriented in its installed and operative positions.

An assembled wafer carrier 68 is then oriented as shown in FIG. 14 with the wafers 72, 72*a*, 72*b*, 72*c* facing the wafer support ring 67 and slid onto the core 59 until the carrier 68 abuts the support ring 67 and the small detent 91 of the support ring 67 engages one of the notches 94 of the wafer carrier 68. It should again be noted that the wafer carrier 68 is not prevented from rotating on the core 59 when sufficient torque is supplied to the wafer carrier 68 to overcome the force of the resilient detent 91.

After the first wafer support ring 67 and wafer carrier 68 have been assembled onto the core 59, the remaining wafer support rings 67, and wafer carriers 68 are alternately assembled onto the core 59 in the same manner to provide a support ring 67 and a wafer carrier 68 for each of the combinating tumblers 46. Thereafter, an additional support ring 67 is then assembled onto the core for the control tumbler 51 which retains the core 59 in the shell 31.

After the support rings 67 and wafer carriers 68 have been assembled onto the core 59, wafer holders 71 of tumblers 46 are then installed in the core 59 by sliding the wafer holders 71 downwardly into the channels formed by the support ring recesses 85 and the transverse apertures 66 of the core 59. During the assembly of the wafer holders 71 into the core 59, the lower end portions 76 of the leaf springs 47 are deflected outwardly by the arcuate lower ends 45 of the wafer holders 71 until the ends 76 of the springs 47 are adjacent to the notches 75 of the wafer holder 71. When the ends 76 of the leaf springs 47 are adjacent to the notches 75, the spring ends 76 return inwardly to engage the notches 75 and lock the wafer holders 71 in the plug 32.

A blocker ring 54, oriented as shown in FIG. 5, is then slid onto the core 59 and an axial force is applied to the blocker ring 54 to depress the detents 91 of the wafer support rings 67 and the retaining ring 61 is snapped into the annular groove 69 at the end of the core 59 to retain the support rings 67, wafer carriers 68, and blocker ring 54 on the core 59.

It should be noted that prior to the combinating of the plug 32, every assembled plug 32 is exactly the same. This allows large numbers of plug assemblies to be made in advance for combinating at a later date to a customer's order or the shipment to a customer uncoded, to allow the customer to combinate its locks in accordance with its needs.

After the plugs 32 have been assembled, they are combinated in accordance with coded keys for a final assembly of the locks.

B. Assembly of the Shell

Figure 18:
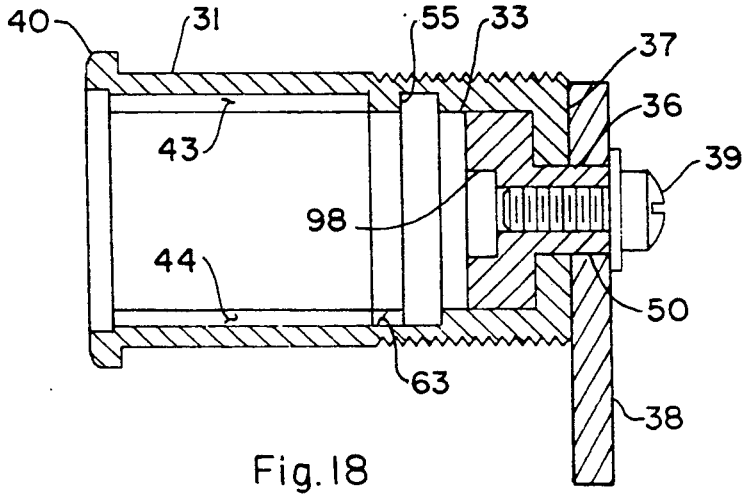
FIG. 18 is a longitudinal view taken on the line 2—2 of FIG. 1 showing the lock after the plug has been removed.

The initial step in the assembly of the shell 31 is the installation of a coupling 33 in the shell 31. The coupling 33 is a generally cylindrical member with a reduced diameter end portion and a square recess 34 at the opposite end portion for engaging the square end portion 35 of the plug 32. The coupling 33 is slidably installed into the shell 31 and its reduced cylindrical end portion 36 is engaged with the aperture 50 in the rear wall 37 of the shell 31. A cam 38 is then attached to the end of the coupling 33 with a standard fastener 39. The completed shell 31 assembly is depicted in FIG. 18.

C. Setting of the initial Code

With the plug 32 assembly out of the shell 31, the plug 32 is inserted into a code setting fixture (not shown) to transfer wafers 72, 72*a*, 72*b*, 72*c* from the wafer carriers 68 onto the wafer holders 71. The code setting fixture is designed to allow access to the top of the plug 32 assembly along its entire length whereby the identification notches on the wafer carriers are visible.

With reference to a particular combination shown on a code sheet, (e.g. 3-1-2-4) (not shown), each of the wafer carriers 68 is rotated by engaging the narrow blade end of a tool (not shown) with the pockets formed by the deeper wafer carrier recesses 96 and rotating the carriers 68 with the tool to position the proper wafers 72, 72*a*, 72*b*, or 72*c* at the uppermost or 12 o'clock position of the plug 32. Using the same tool, the uppermost wafers of the wafer carriers 68 are transferred from the carriers onto the end portions of the wafer holders 71 and the wafer notches 79 engaged with the wafer holder tabs 74. After the proper wafers 72, 72*a*, 72*b*, or 72*c* have been transferred onto the wafer holders 71, the wafer carriers 68 are rotated 45 degrees in either direction to position the wafer carriers 68, as depicted in FIG. 14, in the operating position of the lock 30.

The rotations of the wafer carriers 68 accomplishes three things. First, it aligns a pair of notches 94 of the wafer carrier 68 with the keyhole 65 of the core 59 so that the key 48 can be inserted into the plug 32. Second, it aligns the small detents 91 of the wafer support rings 67 with one of the wafer carrier notches 94 to radially position the wafer carriers 68 on the core 59. Third, it positions the unused wafers 72, 72*a*, 72*b* or 72*c* of the carriers in relationship to flat surfaces of adjacent wafer support rings 67 so that the unused wafers 72, 72*a*, 72*b*, or 72*c* cannot be inadvertently displaced from the wafer carriers 68 to jam the lock 30.

After the plug 32 has been combinated, it is removed from the assembly fixture. When the plug 32 is removed, the tumblers 46 are spring biased downwardly, as shown in FIG. 5, causing end portions 45 of the wafer holders 71 to extend out of the bottom of the core 59 in the same manner as a conventional type plug 32 when a key has been removed. When a properly coded key 48 is inserted into the plug 32, the bited portions of the key 48 act on the control surfaces 82 of the combinating wafers 72, 72*a*, 72*b*, or 72*c* to bias the top edges of the wafers 72, 72*a*, 72*b*, or 72*c* in a shear condition and allow the plug 32 to be rotated to its unlocked position.

Assembly of the Plug into the Shell Assembly

The plug is installed in the shell 31 assembly by inserting the master key 62 into the plug 32, as shown in FIG. 16, orienting the plug 32 with the tab 53 of the blocker ring 54 aligned with the slot 63 of the annular wall 55 of the shell 31, sliding the plug 32 into the shell 31, and removing the master key 62.

Re-combinating a Lock in the Field

For re-combinating a lock in the field to a designated combination, the only things which are required are the master key 62, a code sheet (not shown), the standard key 48 which corresponds to the new combination, and a small blade tool (or very small screw driver). A code setting fixture (not shown) can also be used to facilitate the re-combinating.

The plug 32 is removed from the shell 31 with the master key 62 and the master key 62 is removed from the plug 32. The wafer carriers 68 are rotated to position the recesses 92 of the wafer carriers 68 which are without wafers 72, 72*a*, 72*b*, or 72*c* opposite and adjacent to the combinating wafers 72, 72*a*, 72*b*, or 72*c* which are mounted on the wafer holders 71. The wafers 72, 72*a*, 72*b*, or 72*c* on the wafer holders 71 are then transferred into the empty recesses 92 of the wafer carriers 68 with the bladed tool. After all of the wafers 72, 72*a*, 72*b*, or 72*c* have been transferred onto the wafer carriers 68, the wafer carriers are rotated to position wafers 72, 72*a*, 72*b*, or 72*c*, corresponding to the new code, opposite the wafer holders 71.

The new wafers 72, 72*a*, 72*b*, or 72*c* are then transferred from the wafer carriers 68 onto the wafer holders 71 with the bladed tool and the wafer carriers rotated 45 degrees to engage notches 94 of the wafer carriers 68 with the detents 91 of the wafer support rings 67. The new key 48 is then inserted into the plug 32 to insure that all of the tumblers are in an unlocked or "shear" condition when a proper key 48 is inserted into the plug 32. If this is not so, corrections are made by transferring the incorrect wafers 72, 72*a*, 72*b*, or 72*c* onto the adjacent wafer carrier and replacing the incorrect wafers 72, 72*a*, 72*b*, or 72*c* on the wafer holders 71 with the proper wafers onto the wafer holders 72, 72*a*, 72*b*, or 72*c*. When all of the wafers 72, 72*a*, 72*b*, or 72*c* have been properly installed, the master key 62 is inserted into the plug 32, the plug 32 is inserted into the shell 31, the master key 62 is removed and normal lock function is restored.

From the foregoing it will be understood that our invention provides a cost savings re-keyable wafer tumbler lock which can be used for original installations, as well as to retrofit existing furniture and equipment with a re-keyable wafer tumbler lock. Moreover, the procedure for re-combinating the lock is a simple, easy to use procedure which can be performed by untrained and unskilled persons.

Although but a single embodiment of our invention has been illustrated and described, it is not our intention to limit our invention to this embodiment since it will be appreciated that other embodiments can be derived by obvious changes in material, shape, number, and substitution of parts without departing from the spirit thereof.

We claim:

1. A key operable re-combination wafer tumbler lock comprising: a stationary outer member; a removable plug rotatably mounted in said outer member, said plug comprising a generally cylindrical core, a plurality of multi-piece tumblers slideably mounted in said core, each of said multi-piece tumblers having a holder and a think combinating wafer detachably mounted to an end portion of said holder, a means for resiliently biasing each of said tumblers in locking engagement with said stationary outer member when a proper key does not engage said plug; a means for storing a plurality of optional wafers adjacent to one side of each of said tumblers; a plurality of optional wafers positioned adjacent to each of said tumblers for selectively replacing the combinating wafer on each adjacent tumbler with an optional wafer to re-combinate said lock; and a means for retaining said removable plug in said outer member.

2. The key operable re-combinating wafer tumbler lock recited in claim 1 further comprising a means for supporting each of said combinating wafers on said core.

3. The key operable re-combinating wafer tumbler lock recited in claim 2 wherein said means for supporting each of said combinating wafers on said core comprises a support ring mounted on said core adjacent to each of said tumblers, said support ring being non-rotatable on said core and having a recessed portion for receiving said wafer.

4. The key operable re-combinating wafer tumbler lock recited in claim 3 wherein each of said support rings is adjacent to a forward side of each of said tumblers.

5. The key operable re-combinating lock recited in claim 3 wherein said means for resiliently biasing each of said tumblers in locking engagement with said stationary outer member comprises a leaf spring, said leaf spring being mounted in each of said support rings and having an end portion engaging said tumbler.

6. The key operable lock recited in claim 1 wherein said means for storing a plurality of optional wafers adjacent to one side of each of said tumblers comprises a wafer carrier rotatably mounted on said core adjacent to each of said tumblers, said wafer carrier having a plurality of recessed pockets for storing said optional wafers.

7. The re-keyable lock recited in claim 6 further comprising a means for positioning each of said wafer carriers radially on said core.

8. The key operable re-combinating wafer tumbler lock recited in claim 1 wherein said means for retaining said removable core in said outer member comprises an annular wall in the interior of said stationary outer member, a control tumbler rearward of said wall, said tumbler being slideably mounted in said core and resiliently biased to extend behind said wall to retain said plug in said outer member when a master key for retracting said control tumbler from behind said wall to remove said plug from said outer member does not engage said plug.

9. The key operable re-combinate lock recited in claim 1 further comprising a coupling rotatably mounted in said outer member, one end portion of said coupling being detachably connected to an end portion of said core, and a locking member attached to the other end portion of said coupling for locking an article to which said lock is applied.

10. The key operable re-combinate lock recited in claim 9 wherein said locking member is a cam.

11. The key operable re-combinate lock recited in claim 1 further comprising a means for identifying each of said wafers.

12. The key operable re-combinate lock recited in claim 11 wherein said means for identifying each of said wafers comprises indicia on each of said wafers.

13. The key operable re-combinate lock recited in claim 12 further comprising indicia adjacent to each of said wafers on said means for storing each of said optional wafers.

14. A key-operable re-combinating wafer tumbler lock comprising: a stationary outer member, said member having a cylindrical bore; and a removable plug rotatably mounted in said bore, said plug comprising: a generally cylindrical core, said core having a keyhole extending longitudinally through said core; a plurality of tumblers slideably mounted in said core, at least one of said tumblers being a multi-piece tumbler comprising a thin wafer holder having a front face, a rear face parallel to said front face, a pair of sides, an upper end, a lower end, and a means in one of said faces for detachably mounting a wafer to an end of said wafer holder; a thin generally rectangular combinating wafer detachably mounted on said end of said wafer holder, said combinating wafer having a front face, a rear face parallel to said front face, a pair of sides, an upper end, a lower end, and a means for detachably mounting said wafer to the end of said wafer holder; a means for resiliently biasing each of said tumblers in locking engagement with said stationary outer member when a proper key does not engage said plug; a wafer carrier adjacent to one side of said multi-piece tumbler, said wafer carrier being rotatably mounted on said core for storing a plurality of optional wafers; and a plurality of optional wafers mounted on said wafer carrier, each of said optional wafers being adapted to replace the combinating wafer on said adjacent multi-piece tumbler to re-combinate said lock.

15. A method for re-combinating a key operable wafer tumbler lock of the type having a stationary mounting member and a removable plug rotatably mounted in said mounting member, said plug having a plurality of tumblers slideably mounted in said rotatable plug for selectively bringing said plug in non-rotatable locking relationship with a stationary member and in rotatable unlocking relationship with said stationary member, comprising the steps of:

(a) removing a rotatable plug having at least one slideably mounted multi-piece tumbler, comprising a combinating wafer detachably mounted on a wafer holder, from a stationary member which carries said plug;

(b) rotating a wafer carrier rotatably mounted on said plug adjacent to said multi-piece tumbler, to position an open receiving pocket of said carrier opposite to said multi-piece tumbler;

(c) transferring said combinating wafer onto said open receiving pocket which is opposite to said tumbler;

(d) rotating said wafer carrier to position a wafer carried in another receiving pocket of said carrier opposite to said wafer holder which is adjacent to said wafer carrier;

(e) transferring said wafer onto said adjacent wafer holder;

(f) installing said plug in said stationary member.

16. The method for re-combinating said key operable lock recited in claim 15 further comprising the step of rotating said wafer carrier after said wafer has been transferred onto said wafer holder to position said carrier at its initial position on said plug.

17. A method for re-combinating a key operable wafer tumbler lock of the type having a stationary mounting member and a removable plug rotatably mounted in said mounting member, said plug having a plurality of multi-piece tumblers slideably mounted in said rotatable plug for selectively brining said plug in non-rotatable locking relationship with a stationary member and in rotatable unlocking relationship with said stationary member, comprising the steps of:

(a) removing a rotatable plug having a plurality of slideably mounted multi-piece tumblers, each having a detachable combinating wafer, from a stationary member which carrier said plug;

(b) rotating at least one wafer carrier rotatably mounted on said plug which is adapted to be rotatably mounted in said stationary member to position an open receiving pocket of said carrier adjacent to said multi-piece tumbler which is slideably mounted in said plug;

(c) transferring a combinating wafer from said multi-piece tumbler onto said open receiving pocket which is adjacent to said tumbler;

(d) rotating said carrier to position one of the other wafers carried in another receiving pocket of said carrier opposite to said adjacent tumbler;

(e) transferring said other wafer onto said adjacent tumbler.

* * * * *

UNITED STATES PATENT AND TRADEMARK OFFICE

CERTIFICATE OF CORRECTION

PATENT NO. : 5,168,734

DATED : December 8, 1992

INVENTOR(S) : Robert A. Duval and Merrill A. Dana

It is certified that error appears in the above-identified patent and that said Letters Patent is hereby corrected as shown below:

Title page, item [57]

IN THE ABSTRACT:

Line 7, after and a, change "combining" to --combinating--

Column 4, line 17, after FIGS. 2 and 15, delete "and"

Column 9, line 23, change "re-combination" to --re-combinating--

Column 12, line 6, change "brining" to --bringing--

Column 12, line 13, change "carrier" to --carries--

Signed and Sealed this

Nineteenth Day of October, 1993

Bruce Lehman

*Attest:*

BRUCE LEHMAN

*Attesting Officer*

*Commissioner of Patents and Trademarks*